United States Patent [19]

Von Bennigsen-Mackiewicz et al.

[11] 4,213,855

[45] Jul. 22, 1980

[54] SIFTING EQUIPMENT FOR FINE-GRAINED BULK MATERIAL, PARTICULARLY FLOUR

[76] Inventors: Andreas Von Bennigsen-Mackiewicz; Christoph Von Bennigsen-Mackiewicz, both of 3211 Bantein, Fed. Rep. of Germany

[21] Appl. No.: 826,866

[22] Filed: Aug. 22, 1977

Related U.S. Application Data

[63] Continuation of Ser. No. 541,986, Jan. 17, 1975, abandoned.

[30] Foreign Application Priority Data

Jan. 23, 1974 [DE] Fed. Rep. of Germany ..... 2403091
Dec. 17, 1974 [DE] Fed. Rep. of Germany ..... 2459537

[51] Int. Cl.[2] ..... B07B 1/06; B07B 7/06
[52] U.S. Cl. ..... 209/240; 209/250
[58] Field of Search ..... 209/3, 28–37, 209/240, 241, 242, 250, 233, 136–139 R; 302/59; 55/96, 302

[56] References Cited

U.S. PATENT DOCUMENTS

| | | | |
|---|---|---|---|
| 213,151 | 3/1879 | Washburn | 209/28 |
| 837,311 | 12/1906 | Lauhoff | 209/28 |
| 987,460 | 3/1911 | Heldman | 209/28 |
| 1,001,299 | 3/1912 | Peron | 209/250 X |
| 1,168,543 | 1/1916 | Newhouse | 55/96 |
| 1,223,406 | 4/1917 | Lenders | 209/250 X |
| 1,381,601 | 6/1921 | Torrence | 209/250 X |
| 1,530,193 | 3/1925 | Montgomery | 209/210 X |
| 2,036,534 | 4/1936 | Muirhead | 55/96 X |
| 2,065,079 | 12/1936 | Lanterbur | 209/240 |
| 2,611,486 | 9/1952 | Varcoe | 209/250 X |
| 2,713,977 | 7/1955 | Noll | 209/250 X |
| 2,874,840 | 2/1959 | Simpson | 209/250 |
| 2,904,847 | 9/1959 | Burns | 209/241 X |
| 2,996,183 | 8/1961 | Russum | 209/250 X |
| 3,003,553 | 11/1961 | Winchell | 209/283 |
| 3,011,640 | 12/1961 | Moiness | 209/283 |
| 3,167,503 | 1/1965 | Pitchford | 209/242 |
| 3,254,766 | 6/1966 | Anderson | 209/200 X |
| 3,325,979 | 6/1967 | Smith | 55/302 |
| 3,347,375 | 10/1967 | Mufer | 209/355 |
| 3,386,580 | 6/1968 | Grabarczyk | 209/355 X |
| 3,386,773 | 6/1968 | Ballard | 55/417 X |
| 3,439,800 | 4/1969 | Tonses | 209/239 X |
| 3,483,976 | 12/1969 | Williams | 209/395 |
| 3,580,645 | 5/1971 | Hagenah | 302/59 |
| 3,612,616 | 10/1971 | Stewart | 302/59 X |
| 3,699,747 | 10/1972 | Kroll | 55/96 |
| 3,880,644 | 5/1975 | Ballard | 302/59 |
| 3,918,585 | 11/1975 | Hagelston | 209/3 |
| 3,966,434 | 6/1976 | Frazier | 55/96 |

FOREIGN PATENT DOCUMENTS

| | | | |
|---|---|---|---|
| 614663 | 7/1933 | Fed. Rep. of Germany | 209/137 |
| 964463 | 5/1957 | Fed. Rep. of Germany | 302/59 |
| 93138 | 11/1958 | Norway | 209/138 |
| 632077 | 11/1949 | United Kingdom | 209/321 |

*Primary Examiner*—Robert Halper

[57] ABSTRACT

Sifting equipment for fine-grained bulk material, particularly flour, provided with a transit chamber inserted in the transmission line of the bulk material and containing a sieve, exposed to the action of a blower, is improved by having the transit chamber (9) mounted vertically as regards its lengthwise axis.

23 Claims, 7 Drawing Figures

FIG. 3
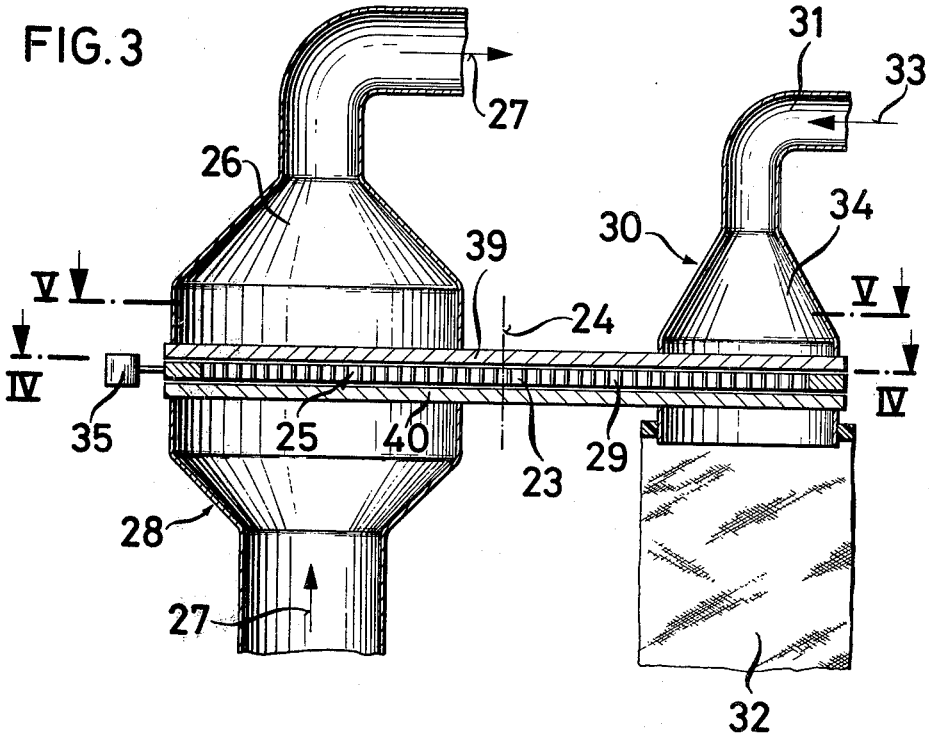
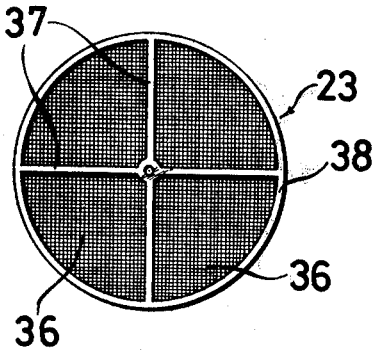
FIG. 4
FIG. 6
FIG. 5
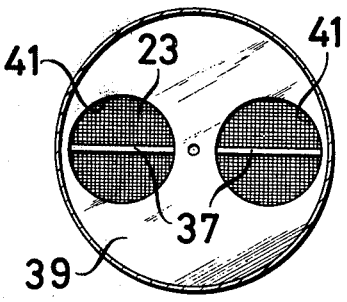
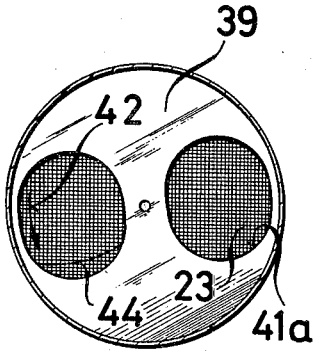

SIFTING EQUIPMENT FOR FINE-GRAINED BULK MATERIAL, PARTICULARLY FLOUR

This is a continuation of application Ser. No. 541,986, filed Jan. 17, 1975 now abandoned.

CROSS REFERENCES TO RELATED APPLICATIONS

Applicants claim priority under 35 U.S.C. 119 for Applications Ser. Nos. P 24 03 091.9 and P 24 59 537.7, filed Jan. 23, 1974 and Dec. 17, 1974 respectively in the Patent Office of the Federal Republic of Germany.

BACKGROUND OF THE INVENTION

The present invention relates to equipment for sifting fine-grained bulk material, particularly flour, provided with a transit chamber exposed to a blower and containing the sieve, this chamber being located in the transmission conduit of the bulk material.

As regards known equipment of this kind, the lengthwise axis of the transit chamber is approximately horizontal and the sieve makes an angle with respect to the direction of transmission. The transit chamber is exposed to a blower, a motor driven wiper provided with rotary wings being located ahead of the sieve.

This prior art equipment suffers from the drawback that upon lengthy operation of the movable wiper, contaminants accumulating even upstream of the sieve will be pushed through the latter, so that this prior art equipment no longer meets the requirement of complete sifting of contaminants.

Similar considerations also apply to any other moving parts provided in the transmission line.

If on the other hand the moving wiper is omitted, the material to be transmitted and sifted accumulates in front of the sieve in the prior art equipment, whereby the transmission is affected appreciably and adversely.

SUMMARY OF THE INVENTION

Therefore the present invention addresses the task of so designing equipment of the kind initially mentioned that for the same or even improved transmission rates, sifting and transmission are feasible in the transmission line in the absence of moving parts.

This problem is solved by the present invention in that the transit chamber is so mounted that its lengthwise axis is vertical.

Such an arrangement allows moving the bulk material evenly and continuously to the sieve by means of the transmitting air jet, this bulk material passing through the sieve without accumulating in front of it, while the contaminants and other undesired particles remain on the upstream side of the sieve during air jet loading. Experiments surprisingly showed that for the same cross sections of transmission line, of transition chamber and of sieve, the transmission rate is not smaller than for the prior art equipment, but rather appreciably larger, as a function of the particular material to be transmitted, than for the equipment operating with moving wipers.

Transmission of the material through the sieve is appreciably facilitated by the blower being designed to be of the suction type and being located downstream of the transit chamber, the supply line to the sieve and the space of the transition chamber upstream of the sieve thereby being evacuated with high reliability of the individual particles of the material being transmitted.

It is further of especial advantage to mount the sieve plane approximately orthogonally to the lengthwise axis of the transit chamber, so as to be approximately horizontal. In this matter the approximate vertical incidence of the individual particles of the material being transmitted ensures their sound removal. To the extent that the composition and consistency of the transmitted material require enlarging the sieve surface while the cross section of the transit chamber remains constant, the sieve may also be slanted with respect to the lengthwise axis of the transit chamber.

The sieve (s) also may be mounted interchangeably in the chamber so as to accommodate bulk materials of different grain sizes.

The dirt particles or contaminants retained at the sieve during the transmission process and possibly also when the air jet is shut off require that they be easily detached and removed. To that end the sieve is provided with a vibration apparatus which imparts the required vibrations when the air jet is shut off and the sieve is in the cleaning position.

In order to further enhance detaching adhering contaminants, a suitable shut-off valve is mounted in the pipe facing the blower. When this valve is actuated, the transmission air jet is interrupted in pulse-like manner, so that the back pressure thus obtained favors detaching the contaminants.

In order to remove contaminants from the equipment, a pipe section is advantageously placed coaxially with the transition chamber and below it, this section being sealed or opened by a hinged door. The supply line in this instance issues between the transit chamber and the pipe section.

An electromagnet is used to reliably operate the hinged door or flap. The pipe section suitably issues in a contaminant container it is fastened to, which accepts contaminants when the hinged door is open.

In order to transmit any bulk material that may accumulate in the pipe section leading to the contaminant container, the latter is provided at its upper end with an annular filter for supplying auxiliary air and which loads the pipe section when the main line is shut off. The contaminant container consists of a flexible, preferably textile material.

In order to clean the pipe segment issuing between the transition chamber and the pipe section, a branch pipe connecting the pipe segment is provided for supplying auxiliary air, this branch pipe being closed by a hinged door, a shut-off valve also being associated with the pipe segment. In this manner the pipe segment is closed while the branch pipe is open, so that any bulk material still in the former is evacuated.

The present invention is applied in especially advantageous manner to store flour in bakeries, the equipment of the present invention in this case being mounted if desired between the storage silos and a metering scale leading to the kneading tub of the bakery.

So as not to interrupt the sifting and transmission process, it is particularly advantageous to have the sieve penetrate the transit chamber only in part and to connect its outer section with a cleaning apparatus.

This arrangement allows cleaning the particular part of the sieve which is external while the transmission and sifting processes go on simultaneously. Thereby one avoids the disadvantageous shut downs otherwise required for cleaning the sieve.

The cleaning apparatus advantageously consists of compressed air equipment blowing through the sieve.

Appropriately this compressed air equipment operates from the top via a pipe section on the sieve, a contaminant container open with respect to the sieve being located underneath it in the region of the pipe section. An especially intensive purification is feasible by means of such compressed air equipment. In this instance too the contaminant container consists of a textile material.

It is further of advantage that the sieve be made in the shape of a circular disk containing mutually bounded individual sifting areas. This sieve is located between two housing disks connected to the transit chamber and fixed in position. In order to bound and seal the particular individual loaded disk areas with respect to the outside, sealing ledges are mounted on the sieve disk, which operate together with the upper and/or lower cover disks. Recesses preferably of circular cross section are suitably provided in these cover disks, whose diameters approximately correspond to the sizes of the individual sifting areas. However, there is no requirement to make the individual sifting areas circular, rather they are designed as sectors bounded by sealing ledges. The number of sectors depends on the size of the sifting disk; but in order for the equipment to remain of manageable size, no more than four sectors are provided, the sealing ledges being orthogonal to each other.

The sieve disk appropriately is rotatably supported about a vertical axis and it is driven intermittently or continuously by a positioning motor. Hydraulic and/or pneumatic units also are conceivable for intermittent drives.

When continuous drive is selected, the recess in the upper cover disk is made larger with respect to the recess of the lower disk by a partial area located in the direction of rotation of the sieve disk. One obtains in this manner that for a rotation of the sieve disk, the sieve is guided into a region which is shielded against the air jet coming from below. Any residual amounts of the bulk material that might have adhered therefore are evacuated from the sieve and therefore do not reach the purification stage.

In addition to or in lieu of the compressed air apparatus, a vibration system is provided for the sifting disk. This system, if desired, is also operated when the sifting equipment is running.

When the lower pipe section below the sieve becomes larger in cross section toward the sieve, there is flow deceleration. Therefore suction holes arrayed in a row are provided in the lower conical pipe section to provide acceleration and to eliminate performance losses. The air loss corresponding to the widening of the cross section is therefore compensated by these holes.

Lastly, a suction pipe connected to the atmosphere and conveying ambient air may be provided for centering the material being conveyed; this suction pipe being mounted at the lower end of the pipe section, its exhaust pointing vertically upward.

In order to generate turbulence and to spread out the material being transmitted, a second suction pipe is provided, the aperture of which is also central with respect to the pipe section, and which points downward. When two suction pipes are provided, their apertures therefore are opposite one another.

In order to filter and/or regulate the air sucked in through the rows of holes, are provided an outer housing equipped with at least one suction pipe which is controlled as to cross section. Such control is performed in known manner by means of flaps or dampers.

Advantageously the sifting disk and/or the sealing ledges and/or the cover disks and/or the individual pipe sections are made of a wear resistant plastic.

BRIEF DESCRIPTION OF THE DRAWINGS

The present invention is best explained by reference to the embodiments shown in the drawings, wherein:

FIG. 3 is a detailed elevation view in diagrammatic form of another embodiment of the sieve equipment of the present invention;

FIG. 4 is a detailed plan view of the sieve of FIG. 3 along the lines II—II;

FIG. 5 is a detailed plan view of the upper cover disk of FIG. 3 along the line III—III;

FIG. 6 is a view similar to FIG. 5 showing another embodiment of the two cover disks.

DESCRIPTION OF THE PREFERRED EMBODIMENTS

Figure 1:
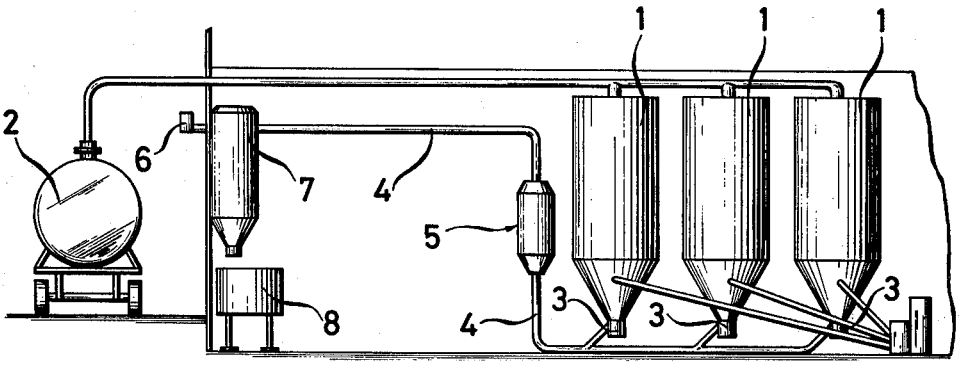
FIG. 1 is a diagrammatic elevation view of a storage facility having incorporated therein the present invention.

As shown in FIG. 1, storage silos 1 are provided in a bakery, which are filled with flour from a supply wagon 2. In order to meter specific amounts from these silos 1, exhaust apertures 3 are connected with a transmission line 4 into which is inserted the sieve equipment 5 designed in conformity with the present invention. Transmission line 4 is exposed to a suction blower 6 moving the flour from silos 1 into a measuring scale 7 whence the flour arrives at a keading tub 8 or the like.

Figure 2:
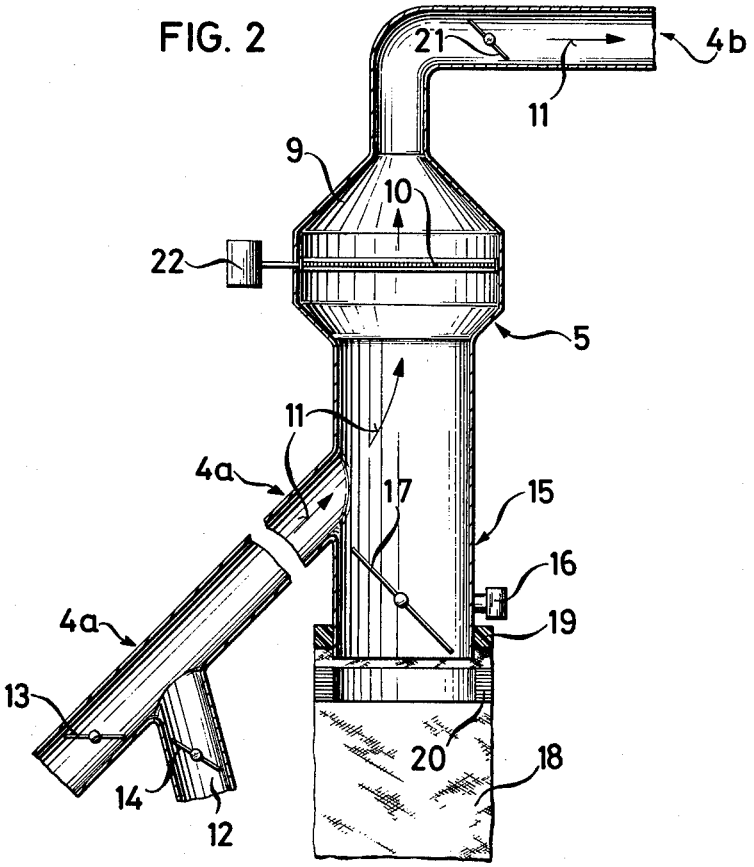
FIG. 2 is a detailed elevation view in cross section of the sieve equipment (5) of FIG. 1.

FIG. 2 shows the sieve equipment of the present invention in detail and in sectional side view. The equipment consists of a transit chamber 9 inserted in transmission line 4, a sieve 10 being shown in approximately horizontal position for the embodiment and this sieve is interchangeable. The air jet for conveying the material is indicated by arrows 11 and is generated but suction blower 6 (FIG. 1). Pipe segment **4*a* upstream of the transit chamber is provided with a branch line 12, pipe segment 4*a* and branch line 12 being closed by hinged flaps or dampers 13 and 14. Branch line 12 supplies auxiliary air in case the line must be cleaned, for instance following a transmission process, by evacuating any residual amounts in pipe section 4*a*. In this case flap or damper 14 is open and flap 13** is closed.

A pipe segment 15 is connected to the vertically mounted transition chamber 9, in coaxial manner and below this chamber this pipe segment may be closed for instance by means of a hinged flap or damper 17 actuated by an electromagnet 16. Pipe segment 15 leads to a contaminant container 18 which may be made of textile material. Contaminant container 18 is mounted by way of a seal 19 to pipe segment 15.

Contaminant container 18 is provided at its upper end with an annular filter 20 used for supplying auxiliary air to pipe segment 15 when, for closed dampers 13 and 14, the latter and adjoining parts of transit chamber 9 must be evacuated.

In order to interrupt the transmission process, exhaust blower 6 (FIG. 1) may be shut off. However, it is an especial advantage that a further damper 21 be associated with pipe section **4*b*** located beyond transit chamber 9, damper 21 interrupting the transmission process in impulse-like manner, so that the back pressure being generated favors detaching the contaminant particles adhering at sieve 10.

The equipment operates as follows:

Even and continuous transmission of the flour through sieve 10 is achieved because of the vertically mounted transit chamber 9 and ensuing sections, especially pipe segment 15, there being no accumulation, and there being furthermore no contaminants being pressed through and performance is appreciably higher than in the prior art equipment. In order to evacuate pipe section 4*a* and pipe segment 15, dampers 14 and 17 are opened when dampers 21 and 13 are respectively open and closed, these dampers 14 and 17 being closed when damper 13 is open during ordinary transmission. The exhaust air jet is interrupted by closing damper 21 in order to remove the contaminants, damper 17 being simultaneously opened so that the contaminants presently dataching from sieve 10 arrive at contaminant container 18. There is no significance in dampers 13 and 14 in this instance being open or closed. Contaminant removal is achieved by actuating vibration apparatus and positioning motor 22 which forces the sieve to vibrate.

FIG. 3 shows a sieve disk 23 which is rotatably supported about a vertical axis 24 and which may be driven continuously or intermittently. Sieve disk 23 penetrates transit chamber 26 with a sector 25. Chamber 26 is part of sieve equipment 28 which is swept by air in the direction of arrows 27.

External sector 29 of sieve disk 23 is connected to a purifying apparatus 30 which in the embodiment shown consists of a compressed air system 31 and a contaminant container 32 made of textile material. The blower of compressed air system 31 moves the compressed air in the direction of arrow 33 through the system, so that the sieve areas covered by pipe increaser 34 are blown clean. Contaminant container 32 is mounted underneath sieve disk 23 in the region of pipe increaser 34. Purification is enhanced if sieve disk 23 is provided in addition or solely with a vibration system 35.

FIG. 4 shows sieve disk 23 in top view and it may be noted that this sieve disk is divided into individual sectors 36 of a circle by sealing ledges 37 pointing upward or downward, which sectors are four in number in the example shown. The sealing ledges are orthogonal to each other. These sectors are bounded externally by a sealing rim 38 of the same height.

Sieve disk 23 passes between two housing disks 39 and 40 (see FIG. 3) which are fixed and connected to transit chamber 26, ledges 37 and 38 performing the required sealing.

FIG. 5 shows view III—III of FIG. 3 and upper housing disk 39 in top view, the lower housing disk being covered. As shown by FIG. 5, recesses 41 are provided in upper cover disk 39, the diameters of which approximately correspond to the magnitude of the individual sieve areas determined by sectors 36. One of the recesses 41 is associated with sieve equipment 28, i.e., with transit chamber 26, and the other with purification system 30.

When sieve disk 23 is driven continuously, it is appropriate to enlarge at least recess 41*a* associated with transit chamber 26 by a partial surface 44 located in the direction of motion, indicated by arrow 42 of sieve disk 23 with respect to the corresponding and associated recess in the lower cover disk 40, as shown in FIG. 6. Upon rotation of the sieve disk, the sieve is guided in this manner to a region shielded with respect to the air stream coming from the bottom and corresponding to partial area 44, so that the sieve section above partial area 44 is exposed only to the upper suction air. Any flour still adhering therefore is not carried along into the purification system.

Figure 7:
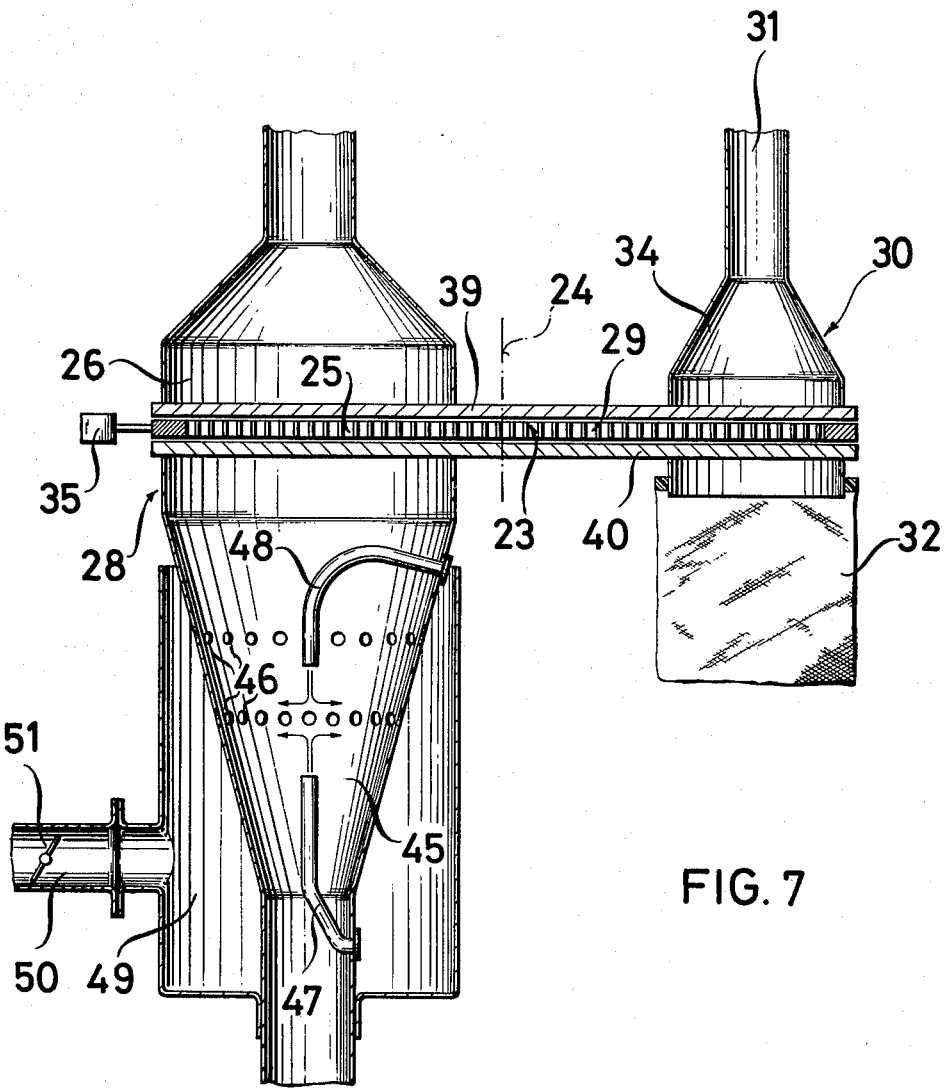
FIG. 7 is a detailed elevation view in diagrammatic form of yet another embodiment of the sieve equipment of the present invention.

FIG. 7 shows an embodiment incorporating air suction holes 46 in row arrangement in the lower conical pipe increaser 45 of sieve equipment 28 for the purpose of acceleration and elimination of performance losses. This arrangement furthermore provides suction pipes 47 and 48 for ambient air, with centrally located exhausts and serves to center or to distribute the material being transmitted.

An outer housing 49 surrounding pipe increaser 45 is provided for filtering and/or regulating the sucked-in amounts of air, this housing being provided with at least one suction pipe section 50 which may be regulated as to cross section. Regulation in the example shown is performed by a hinged flap or damper 51. A filter may be inserted into pipe section 50.

We claim:

1. Sifting apparatus for fine grained bulk material comprising:

(a) a storage receptacle for said bulk material;

(b) receiving means for use of said bulk material;

(c) a transmission line connecting said storage receptacle and said receiving means;

(d) transit chamber means with a lengthwise axis mounted vertically as regards its lengthwise axis in said transmission line, said transit chamber means having a transmission line inlet connected to said transmission line between said storage receptacle and said transit chamber means, a transmission line outlet connected to said transmission line between said transit chamber means and said receiving means and a sifted material outlet at the bottom of said transit chamber means;

(e) a suction blower mounted in said transmission line between said transit chamber means and said receiving means;

(f) sieve means mounted in said transit chamber means approximately orthogonal to said lengthwise axis of the transit chamber means;

(g) a shut off valve mounted in said transmission line outlet that interrupts the transmission process in impulse-like manner, thereby generating back pressure for detaching contaminant particles adhering to said sieve means, said transmission line inlet positioned between a first hinged damper and said shut off valve;

(h) said first hinged damper positioned in said sifted material outlet and opening simultaneously with the interruption of said transmission process.

2. The apparatus of claim 1, wherein said sieve is a rotatable sieve and comprises one sector (25) and other sector (29) said transit chamber being penetrated only by one of said sectors, at a time while said other sector is adjacent a purification system (30) for further removal of contaminant particles.

3. The apparatus of claim 2, wherein said purification system (30) consists of a compressed air system (31) blowing through said sieve (23).

4. The apparatus of claim 3, wherein said compressed air system blows from above through a pipe expanded in the direction of said sieve onto said sieve and below said sieve a contaminant container which is open with respect to said sieve is mounted in the region of said pipe expanded in the direction of said sieve.

5. The apparatus of claim 4, wherein said contaminant container (32) is made of a textile material.

6. The apparatus of claim 1, wherein said sieve means is a circular sieve disk comprising individually bounded sieve surfaces and said sieve disc is rotatably supported about a vertical axis.

7. The apparatus of claim 6, wherein said circular disk passes between two housing disks (39, 40) which are fixed and connected to transit chamber (26) and extend beyond same and cover said sieve disk (23).

8. The apparatus of claim 7, wherein sealing ledges (37, 38) are mounted on said sieve disk (23), which operate together with said housing disks (39, 40).

9. The apparatus of claim 6, wherein said sieve disk has means for vibrating.

10. Sifting apparatus for fine grained bulk material comprising:

(a) a storage receptacle for said bulk material;
(b) receiving means for use of said bulk material;
(c) a transmission line connecting said storage receptacle and said receiving means;
(d) transit chamber means with a lengthwise axis mounted vertically as regards its lengthwise axis in said transmission line, said transit chamber means having a transmission line inlet connected to said transmission line between said storage receptacle and said transit chamber means, a transmission line outlet connected to said transmission line between said transit chamber means and said receiving means and a sifted material outlet at the bottom of said transit chamber means;
(e) a suction blower mounted in said transmission line between said transit chamber means and said receiving means;
(f) sieve means comprising a circular sieve disk having individually bounded sieve surfaces mounted in said transit chamber means approximately orthogonal to said lengthwise axis of the transit chamber means and rotatably supported about a vertical axis;
(g) a first hinged damper positioned in said sifted material outlet;
(h) a shut-off valve mounted in said transmission line outlet adapted to interrupt the transmission process in impulse-like manner, generating back pressure for detaching contaminant particles adhering to said sieve means;
(i) said circular disk passing between two housing disks (39, 40) which are fixed and connected to said transit chamber means (26) and extending beyond same and covering said sieve disk (23);
(j) sealing ledges (37, 38) mounted on said sieve disk (23), said sealing ledges operating together with said housing disks (39, 40); and
(k) recesses of circular cross section (41) located in said housing disks, said circular cross section having diameters corresponding approximately to the magnitudes of said individual sieve surfaces.

11. The apparatus of claim 10, wherein said individual sieve surfaces (36) are sectors of a circle bounded by sealing ledges (37, 38).

12. The apparatus of claim 11, wherein said sectors are four in number and said sealing ledges (37) are mutually orthogonal.

13. The apparatus of claim 10, wherein said recess (41*a*) in said upper housing disk (39) is enlarged with respect to the recess in said lower housing disk (40) by a partial area (44) located in the direction of rotation (42) of said sieve disk (23).

14. The apparatus of claim 10, wherein said sifted material outlet has a contaminant container connected thereto.

15. The apparatus of claim 14, wherein said contaminant container has an annular filter at its upper end.

16. The apparatus of claim 15, wherein said contaminant container is constructed of a flexible material.

17. The apparatus of claim 16, wherein said flexible material is a textile.

18. The apparatus of claim 10, wherein said sieve disk, said sealing ledges and said cover housing disks are made of wear resistant plastics.

19. Sifting apparatus for fine grained bulk material comprising:

(a) a storage receptacle for said bulk material;
(b) receiving means for use of said bulk material;
(c) a transmission line connecting said storage receptacle and said receiving means;
(d) transit chamber means with a lengthwise axis mounted vertically as regards its lengthwise axis in said transmission line, said transit chamber means having a transmission line inlet connected to said transmission line between said storage receptacle and said transit chamber means, a transmission line outlet connected to said transmission line between said transit chamber means and said receiving means and a sifted material outlet at the bottom of said transit chamber means;
(e) a suction blower material in said transmission line between said transit chamber means and said receiving means;
(f) sieve means mounted in said transit chamber means approximately orthogonal to said lengthwise axis of the transit chamber means;
(g) a first hinged damper positioned in said sifted material outlet;
(h) a shut-off valve mounted in said transmission line outlet adapted to interrupt the transmission process in impulse-like manner, generating back pressure for detaching contaminant particles adhering to said sieve means; and
(i) said transmission line inlet having a sealing damper mounted therein, an auxiliary air pipe connected to said transmission line inlet between said sealing damper and said transit chamber means and a second hinged damper mounted in said auxiliary air pipe, said transmission line inlet positioned between said first hinged damper and said shut-off valve.

20. Sifting apparatus for fine grained bulk material comprising:

(a) a storage receptacle for said bulk material;
(b) receiving means for use of said bulk material;
(c) a transmission line connecting said storage receptacle and said receiving means;
(d) transit chamber means with a lengthwise axis mounted vertically as regards its lengthwise axis in said transmission line, said transit chamber means having a transmission line inlet connected to said transmission line between said storage receptacle and said transit chamber means, a transmission line outlet connected to said transmission line between said transit chamber means and said receiving means and a sifted material outlet at the bottom of said transit chamber means;

(e) a suction blower mounted in said transmission line between said transit chamber means and said receiving means;

(f) sieve means comprising a circular sieve disk having individually bounded sieve surfaces mounted in said transit chamber means approximately orthogonal to said lengthwise axis of the transit chamber means and rotatably supported about a vertical axis;

(g) a first hinged damper positioned in said sifted material outlet; and (h) a shut-off valve mounted in said transmission line outlet adapted to interrupt the transmission process in impulse-like manner, generating back pressure for detaching contaminant particles adhering to said sieve means, said transit chamber means having a lower conical pipe segment expanded in the direction of said sieve disk with suction holes provided therein and said holes arranged in a row.

21. The apparatus of claim 20, wherein a suction pipe is connected to the atmosphere and conveys a portion of same, said suction pipe is mounted in the lower end of said conical pipe segment and has an exhaust orifice pointing vertically upward.

22. The apparatus of claim 21, wherein a further suction pipe (48) is provided, the orifice of which is located centrally with respect to said pipe increaser (45) and points downward.

23. The apparatus of claim 22, wherein an outer housing (49) is provided which surrounds the conical pipe (45) and comprises in its cross section at least one valve regulated suction pipe (50).

* * * * *